US008414418B2

(12) United States Patent
Doran

(10) Patent No.: US 8,414,418 B2
(45) Date of Patent: Apr. 9, 2013

(54) HYBRID GOLF CLUB HEAD

(76) Inventor: Mark Doran, Port Saint Lucie, FL (US)

( * ) Notice: Subject to any disclaimer, the term of this patent is extended or adjusted under 35 U.S.C. 154(b) by 216 days.

(21) Appl. No.: 12/888,104

(22) Filed: Sep. 22, 2010

(65) Prior Publication Data

US 2011/0118053 A1 May 19, 2011

Related U.S. Application Data

(63) Continuation-in-part of application No. 12/250,722, filed on Oct. 14, 2008, now abandoned.

(51) Int. Cl.
*A63B 53/04* (2006.01)

(52) U.S. Cl.
USPC ..... 473/324

(58) Field of Classification Search ..... 473/324, 473/345–346, 349–350, 290–291
See application file for complete search history.

(56) References Cited

U.S. PATENT DOCUMENTS 5,931,741 A * 8/1999 Fenton, Jr. ..... 473/305
6,099,414 A * 8/2000 Kusano et al. ..... 473/342
D446,268 S * 8/2001 Satoh et al. ..... D21/733
6,729,970 B2 * 5/2004 Horwood et al. ..... 473/289
7,137,903 B2 * 11/2006 Best et al. ..... 473/290
7,513,835 B2 * 4/2009 Belmont ..... 473/328
D596,684 S * 7/2009 Sutovsky et al. ..... D21/747
2004/0106463 A1 * 6/2004 Horwood et al. ..... 473/289
2007/0042837 A1 * 2/2007 Bamber ..... 473/349
2008/0051210 A1 * 2/2008 Park et al. ..... 473/291

* cited by examiner

*Primary Examiner* — Stephen L. Blau
(74) *Attorney, Agent, or Firm* — Dinsmore & Shohl LLP

(57) ABSTRACT

A hybrid golf club head for producing accurate and long distance shots, where the head includes: a body member having a hitting surface, a top surface, a toe end, a heel end, and a sole surface extending between the toe end and the heel end, and a shaft attachment portion extending from the heel end upwardly and rearwardly therefrom, wherein width of the top surface near the shaft attachment portion ranges from about ¾ inches to about 1 inch, and width of the top surface near the toe end ranges from about 1 inch to 1 & ⅝ inches; and wherein the hitting surface is inclined at a predetermined angle with respect to a shaft axis to produce the accurate and the long distance shots, further wherein the length (L) of the hitting surface 14 is about 4 inches and the breadth (B) ranges from about 1¾ inches to about 2½ inches.

5 Claims, 4 Drawing Sheets

HYBRID GOLF CLUB HEAD

CROSS REFERENCE TO OTHER APPLICATIONS

This application claims is a continuation in part to U.S. application Ser. No. 12/250,722 filed on Oct. 14, 2008 now abandoned.

BACKGROUND OF THE INVENTION

1. Field of Invention

The present invention relates to a golf club with a specialized head to provide a unique hybrid driver head.

2. Description of Related Art

Golf is an outdoor sport played by many individuals for recreational and competitive purposes on golf courses throughout the world. The golf game is played with a small ball that is struck by a club. Each golfer uses a set of clubs while playing golf where the set includes at least a driver, woods, irons and a putter. The golf club is comprised of three basic components, the grip, the shaft and the head. The head portion strikes the ball and accordingly the grip is the portion of the club that is held by the golfer's hand and the shaft extends between the head and the grip. The different clubs are used at different distances and depending on the lie of the ball on the golf course. A putter is used exclusively on or near the greens for putting a ball short distances to the hole. Irons vary in shaft length and loft angle and thus vary in distance that may be achieved with each club. Higher irons are used for shorter distances and lower irons are typically used for longer distances. If a golfer is a significant amount of distance from a hole a golfer may choose to use a fairway wood, which has a larger head. The one distinction between the iron and the wood club is particularly the head size and shape. Irons are angled from about 16 to 48 degrees with a sloping hitting surface. The angle and sloping surface enable the golfer to manipulate the distance and lift of the golf ball when striking it. The heads of the iron are usually made of steel or some other metal and forged by hammering hot metal under great pressure. A typical iron has a shorter shaft as compared to a wood because the iron is used for shorter distances and therefore less energy is transferred with a shorter shaft as opposed to the longer shaft of the typical wood.

A wood club has a larger head than an iron and most are designed to send the ball 200 yards or more and in particular the driver is typically the largest wood in a set of clubs where the driver is used to tee the ball at the beginning of a hole. The shaft of the wood club is usually considerably longer than the other clubs. The greater length increases the power transferred to the ball however the club driver can be more difficult to swing because of the increased likelihood that the ball doesn't hit the designated sweet spot of the club. The club's sweet spot is the middle of the club face that's the optimum position to strike the ball when hitting a golf ball. Various designers have used different techniques to improve the likelihood of a golfer hitting the sweet spot when swinging a driver. Heavier club heads were used to help resist twisting and use different weight techniques such as a center weighting or perimeter weighting to aid the golfer in achieving a more perfect swing. A lighter head can be swung at a greater speed and may generate more energy to transfer the ball however the golfer must be careful to maintain the club in a straight position when striking the ball. Most drivers have a large head and many with modern designed drivers have exaggerated large heads that are made of steel, titanium, bronze or other metals. The driver head shape allows the head to glide over the grass and ground rather than digging into the turf. Most tee shots are made with a tee that is used to elevate the ball above the ground level.

The third type of club has been developed over the recent years to assist golfers in replacing some of the longer irons that are typically difficult to consistently hit with accuracy. Golf designers have determined that many irons with a 24-degree or less loft and a 38 or more inch length are difficult to hit consistently by the average golfer. This equates typically to any iron longer than a five iron. A hybrid golf club has been developed to replace the two, three, four irons to provide the golfer with a more reliable club to hit as opposed to the two, three, four irons. The typical hybrid club combines elements of iron and woods and helps the golfer utilize these features to strike balls on the fairway that would be typically addressed with a two, three or four iron. Consequently, all the hybrid clubs that are currently on the market are designed for striking the ball on the fairway after the tee shot.

There still remains a need to assist a golfer with their drive or their initial tee shot. As stated above various designs of wood clubs used for driving have been implemented however a hybrid club for driving remains non-existent for the golfer. Many golfers may be able to utilize a hybrid head for a driver that thus lightens the weight of the head and therefore provides an opportunity for the golfer to transfer more energy in the swing when driving a ball off the tee. The present hybrid clubs on the market again are used to replace irons therefore the loft angles associated with the hybrid club are usually above 15 degrees or greater particularly because the hybrid club is used as a replacement club for irons as opposed to a replacement for a driver.

SUMMARY OF THE INVENTION

The present invention relates to a hybrid golf club head for producing accurate and long distance shots comprising: a body member having a hitting surface, a top surface, a toe end, a heel end, and a sole surface extending between the toe end and the heel end, and a shaft attachment portion extending from the heel end upwardly and rearwardly therefrom, wherein width of the top surface near the shaft attachment portion ranges from about ¾ inches to about 1 inch, and width of the top surface near the toe end ranges from about 1 inch to 1 & ⅝ inches; and wherein the hitting surface is inclined at a predetermined angle with respect to a shaft axis to produce the accurate and the long distance shots, further wherein the length (L) of the hitting surface 14 is about 4 inches and the breadth (B) ranges from about 1¾ inches to about 2½ inches.

DETAILED DESCRIPTION

The present invention relates to a hybrid driver head that produces a low trajectory while resulting in a straight and distant shot suitable for driving a golf ball. The driver hybrid club head may be made of various materials such as steel, graphite, titanium and/or iron and may be attached to a shaft of a comparable to a driver, three wood, five wood, two iron, three iron or four iron. This driver hybrid head club is unique in that it maintains a loft angle on the club face between 9 to 13 degrees. The driver hybrid head according to the present invention utilizes a loft angle of 9 to 13 degrees in order to produce a low trajectory of a tee shot and therefore produces a straighter, longer and more consistent drive than the typical wood club head. Modern designs of driver heads have been getting increasingly larger as opposed to the present invention which is a driver head that uses a smaller head that provides a suitable loft and a head striking surface that is shaped like an oversized iron for the portion of a head behind the striking surface.

Many modern hybrid clubs used presently have larger loft angles of 13 to 23 degrees and are specifically designed for replacing the longer irons two, three, four or possibly five. This increased loft angle provides a higher trajectory that is usually used as a recovery club in a rough area or in a difficult spot on the fairway. The present invention, a driver hybrid head club, is specifically designed for teeing off or driving a golf ball as a replacement for the typical driver presently used.

Use of the driver hybrid head club according to the present invention allows the golfer to strike the ball but more consistently compared to a typical driver club and creates the low trajectory suitable for driving. Further the golfer may transfer greater energy to the golf ball due to the smaller size of the head and therefore decrease weight of the head size.

Figure 1:
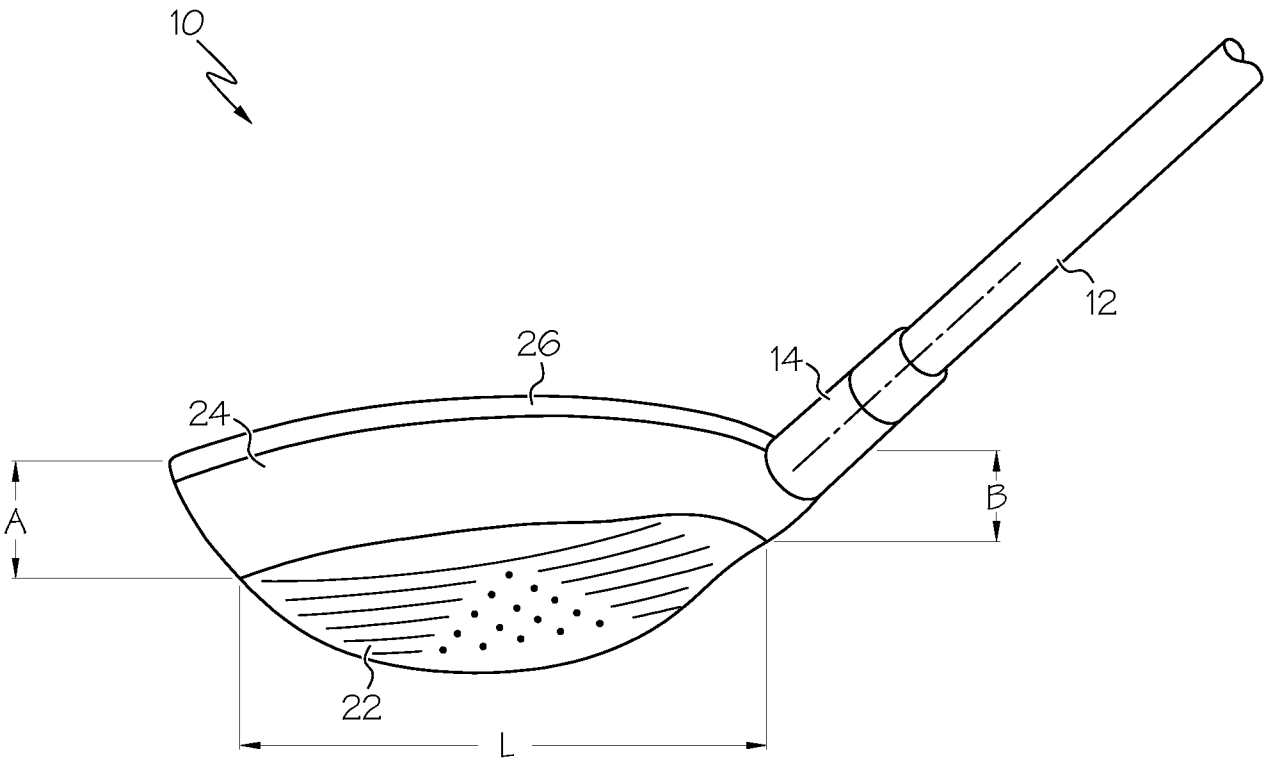
FIG. 1 depicts a perspective view of the hybrid driver head according to the present invention.

FIG. 1 depicts the perspective view of the Driver Hybrid Head 10 according to the present invention. The Hybrid Head 10 includes a Hitting Surface 22. The Head 10 includes the Top Surface 24 and a Back Side 26. Various measurements are provided at different positions on the Hybrid Head 10 such as (L) which is measured from the point of intersection of the shaft and Head 10 to the toe of the Head 10 as shown. Another length (A) is depicted at the toe of the Head 10 and another prospective length (B) is depicted at the butt of the Head 10. The Hybrid Head 10 includes a loft, which is preferably in the range of 9 degrees to about 13 degrees. This loft provides a suitable angle for driving a golf ball. The Head 10 is attached to a Shaft 12 through the Attachment Means 14. The Head 10 may be attached to the Shaft 12 in any suitable manner as known and used in the art such as using adhesive cements, welding soldering, mechanical connectors such as threads and retaining elements. The length of the Shaft 12 may vary however in its preferred embodiment the length of the shaft would be comparable to the length of a typical driver which is about 43 to 44 inches however the Head 10 may be utilized on shorter length shafts where the shaft may be as short as 38 inches comparable to a four iron ranging to a 43-inch length of a three wood or driver.

Figure 2:
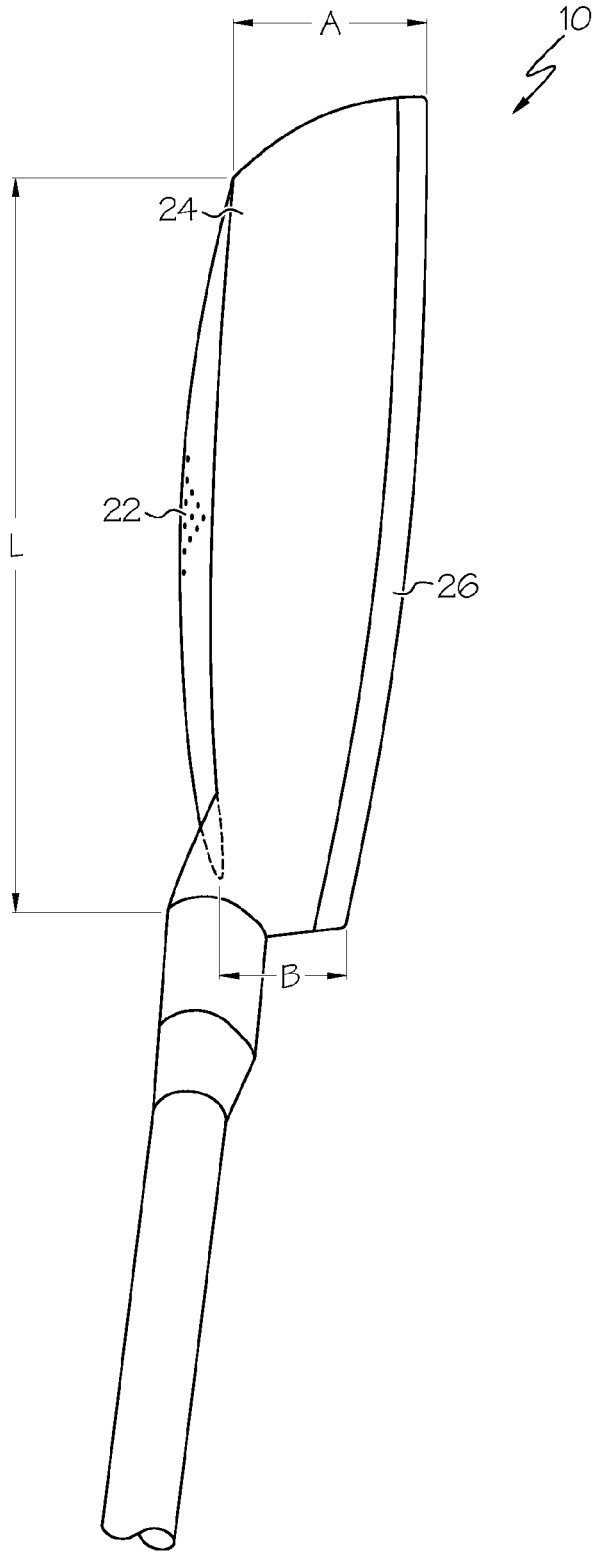
FIG. 2 depicts the top view of the hybrid head according to the present invention.
Figure 3:
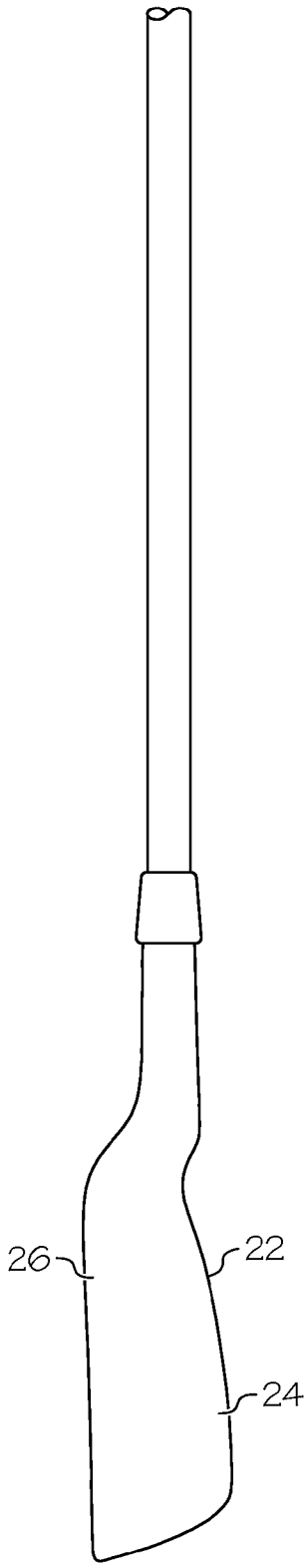
FIG. 3 depicts the front view of the hybrid head according to the present invention.
Figure 4:
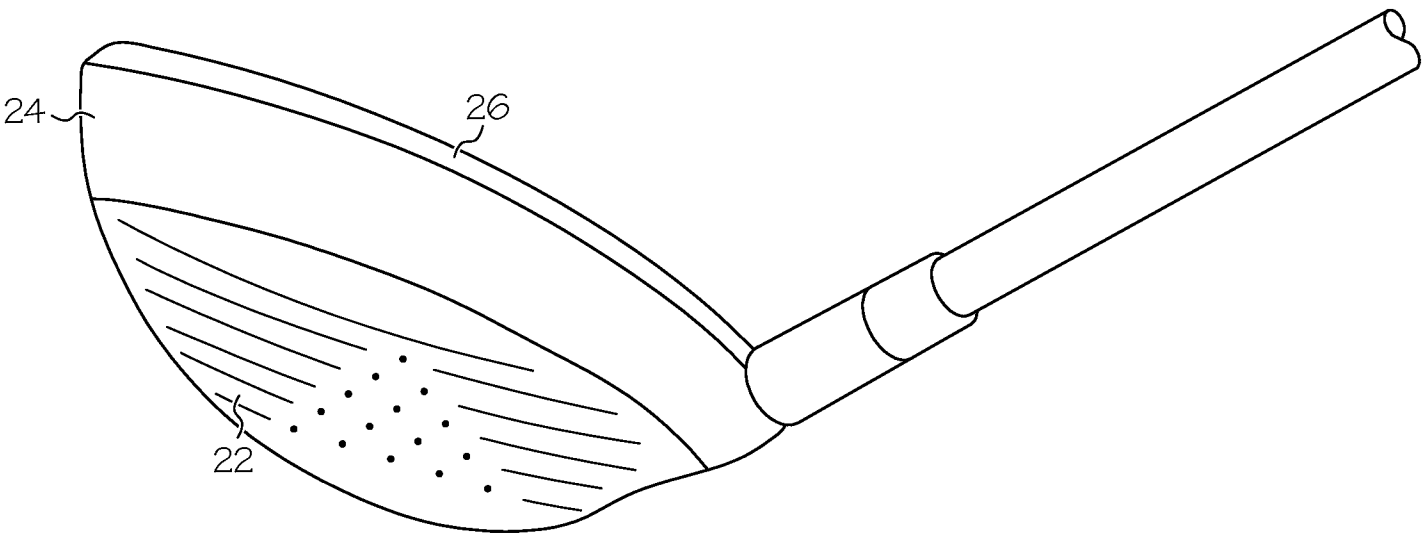
FIG. 4 depicts yet another perspective view of the hybrid head according to the present invention.

FIG. 2 depicts a top view of the Hybrid Driver Club 10 and provides a more clear view of the Length A of the toe of the Club 10. Also the Striking Surface 22 on one side and the Back Side 26 are depicted. It is noted that the Back Side 26 may have a slope or slightly angled shape that is comparable to an iron however it is noted that the Length A is comparably short similar to the hybrid club that is used to replace the iron. The particular driver hybrid Club Head 10 includes a loft angle that is suitable and conducive for driving. FIG. 3 depicts yet another view of the Hybrid Club 10 according to the present invention and FIG. 4 provides yet another prospective view of the Hybrid Club 10 according to the present invention. It is noted that the Hitting Surface 22 may include a plurality of horizontal grooves and a designated sweet spot. Due to the size of the hybrid driver club head according to the present invention, the golfer is more likely to have a controlled swing and more likely to hit the sweet spot of the Hitting Surface 22.

The design of the Hybrid Driver Club Head 10 enables the golfer to hit balls more consistently as opposed to the traditional wood head that is used for a driver. Further the Hybrid Head 10 may be utilized in various shaft lengths however is still capable of providing a drive of sufficient distance for the user. Use of the Driver Head 10 according to the present invention can produce drives upwards to 300 yards comparable to any traditional wood head presently known in the art. Further the driver head according to the present invention is utilized as a driver as opposed to a recovery club as known with the hybrid clubs in the art. The driver club head according to the present invention is designed to weigh between 185 grams and 300 grams. This weight is lighter than the traditional driver which normally weighs 350 grams to 450 grams but however larger than the standard iron which weighs between 150 to 250 grams. Furthermore, the hybrid driver club head according to the present invention utilizes a suitable loft for driving a golf ball and provides a more accurate and consistent means to drive a ball off a tee. The instant invention has been shown and described in what it considers to be the most practical and preferred embodiments. It is recognized, however, that departures may be made there from within the scope of the invention and that obvious modifications will occur to a person skilled in the art.

What is claimed is:

1. A hybrid golf club head for producing accurate and long distance shots comprising:

a body member having a hitting surface, a top surface, a toe end, a heel end, and a sole surface extending between the toe end and the heel end, and a shaft attachment portion extending from the heel end upwardly and rearwardly therefrom away from the toe end, the shaft attachment portion defining a shaft axis, wherein a first width of the top surface near the shaft attachment portion ranges from about ¾ inches to about 1 inch, and a second width of the top surface near the toe end ranges from about 1 inch to 1 & ⅝ inches; and wherein the hitting surface is inclined at a predetermined angle with respect to the shaft axis, further wherein the length (L) of the hitting surface is about 4 inches.

2. The hybrid golf club head of claim 1, wherein the predetermined angle ranges from about 9 degrees to about 13 degrees.

3. The hybrid golf club head of claim 1, wherein the hitting surface comprises a plurality of horizontal grooves configured thereon.

4. The hybrid golf club head of claim 1, wherein the club head is cast from at least one of stainless steel, titanium alloy, high-tensile aluminum alloy steel, graphite, and aluminum.

5. The hybrid golf club head according to claim 1, where a weight of the club head ranges from about 185 grams to about 300 grams.

* * * * *